US007915536B1

(12) United States Patent
Hackett

(10) Patent No.: US 7,915,536 B1
(45) Date of Patent: Mar. 29, 2011

(54) EASY SNAP INSULATOR

(76) Inventor: Richard Allen Hackett, Elmira, OR (US)

( * ) Notice: Subject to any disclaimer, the term of this patent is extended or adjusted under 35 U.S.C. 154(b) by 234 days.

(21) Appl. No.: 12/380,262

(22) Filed: Feb. 26, 2009

Related U.S. Application Data

(60) Provisional application No. 61/125,406, filed on Apr. 25, 2008.

(51) Int. Cl.
*H01B 17/16* (2006.01)

(52) U.S. Cl. ..... 174/163 F; 174/158 F; 174/160; 174/159; 174/163 R; 248/72; 256/10

(58) Field of Classification Search ..... 174/158 F, 174/160, 161 R, 161 F, 162, 163 F, 159, 163 R; 248/72; 256/10, 47, 50
See application file for complete search history.

(56) References Cited

U.S. PATENT DOCUMENTS

| | | | | |
|---|---|---|---|---|
| 5,412,158 | A * | 5/1995 | Yearwood | 174/163 F |
| 5,959,255 | A * | 9/1999 | Langlie et al. | 174/161 F |
| 6,563,055 | B1 * | 5/2003 | Burdick | 174/158 F |
| 6,872,892 | B1 * | 3/2005 | Burdick | 174/158 F |
| 6,960,728 | B1 * | 11/2005 | Halderman | 174/158 F |

* cited by examiner

*Primary Examiner* — Dhiru R Patel

(57) ABSTRACT

One embodiment of a poly prophelene. It's unique design allows it to slide over and to fit snugly onto a vinyl or wood rail fence. It requires no mechanical fasteners such as screws or nails. It holds onto the rail by gravity pressure, and the return clip on the bottom end and utilizes the structure and strength of the rail to support it. It is injection molded in one piece, with a living hinge at the top to hold the electric fence wire, rope, or ribbon up to 1½ inches wide. It is made of poly prophelene with a Ultra Violet blocker. Each unit weighs about one ounce and are very durable and safe as they will bend rather than break. As with most vinyl based material they have a memory and will return to there manufactured shape if you bend them. We can produce them in a variety of colors to meet the customer's needs.

1 Claim, 9 Drawing Sheets

Figure 1B – Shows a 3 Dimensional view of the invention

Figure 1C – Shows a 3 dimensional side view of the invention with the electric tape inserted into the Living Hinge.

Figure 1D – Shows a 3 dimensional side view of the invention with the electrical rope inserted into the Living Hinge.

Figure 2A (side view)
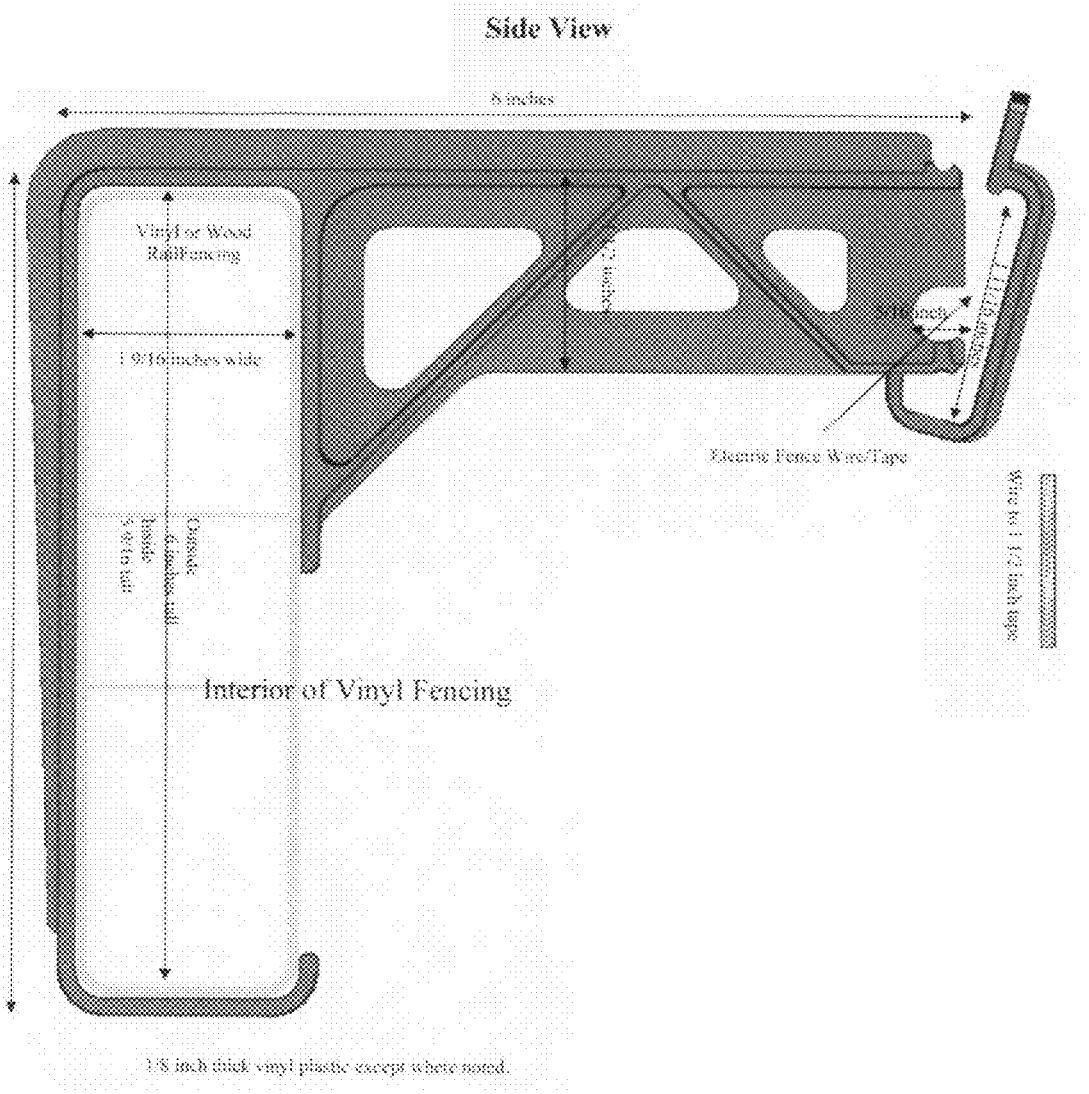

Figure 2B (top view)
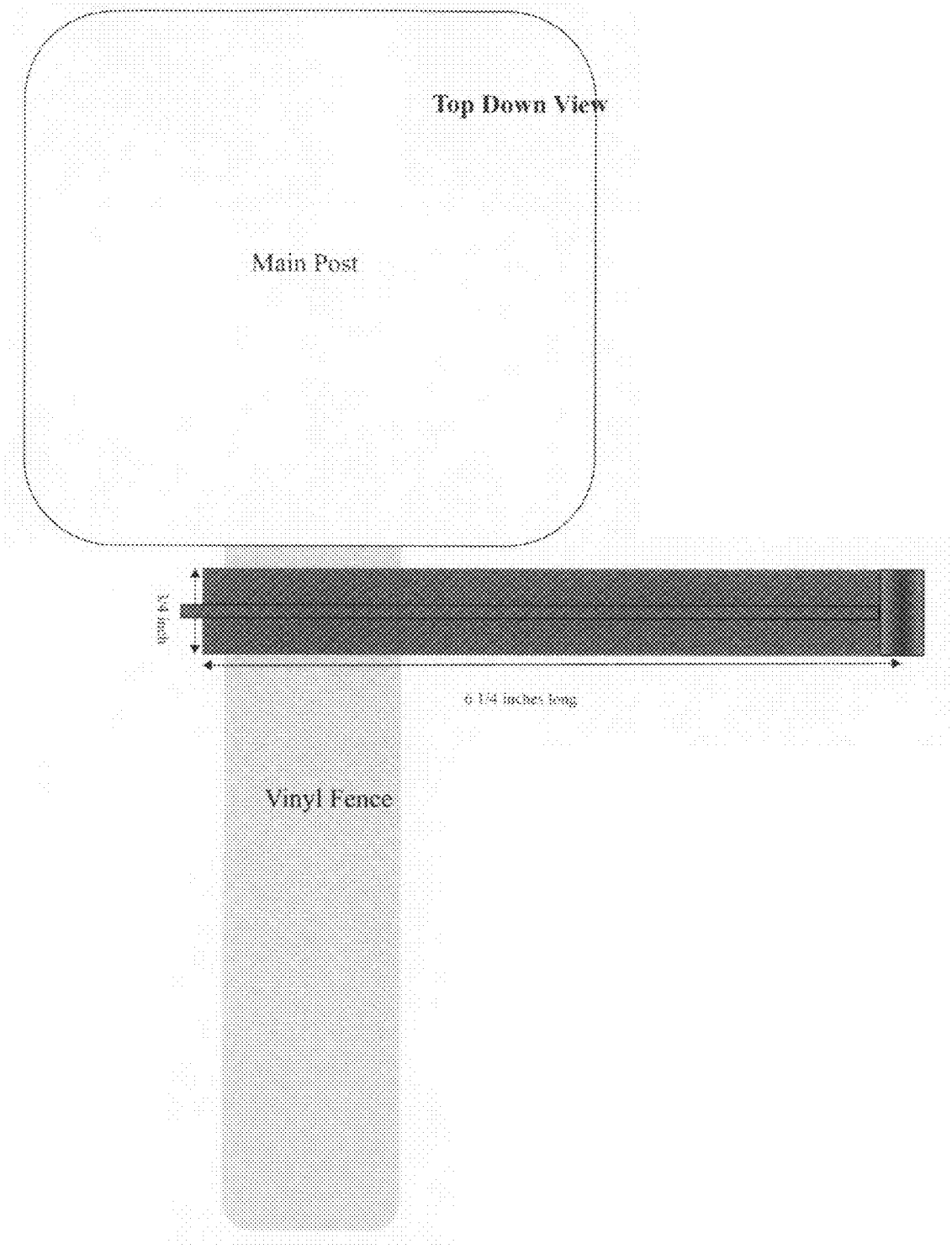

Figure 2C (front view)
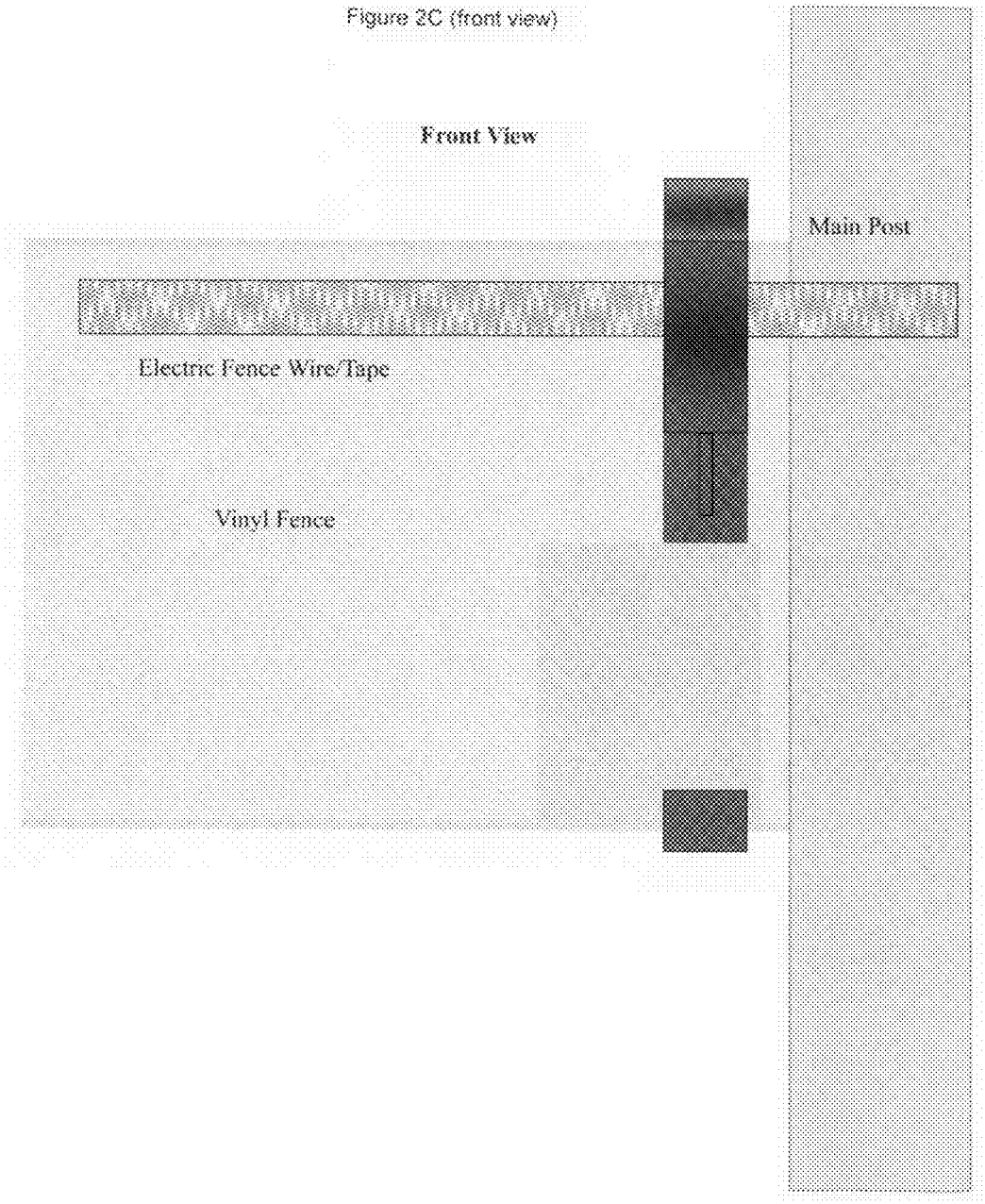

Figure 3A – Shows an optional design for the invention with a rail latch at the bottom of the insulator.

Figure 3B – Shows an optional design for the invention for a 1" x 6" rail fence with a rail latch at the bottom of the insulator.

Figure 3C – Shows an optional T Bar design that allows for electric fencing on both sides of the insulator with no latch at the bottom of the invention.

Figure 3D – Shows an optional T Bar dual design that allows for electric fencing on both sides of the invention with a rail latch at the bottom.

EASY SNAP INSULATOR

CROSS-REFERENCE TO RELATED APPLICATIONS

This application claims the benefit of provisional patent application Ser. No. 61/125,406 filed on Apr. 25, 2008 by the present inventor. This also relates to the Mar. 19, 2009 and May 1, 2009 Notice to File Corrected Application Papers sent in response to original patent application Ser. No. 12/380,262 filed on Feb. 26, 2009.

FEDERALLY SPONSORED RESEARCH

Not applicable

SEQUENCE LISTING OF PROGRAM

Not applicable

BACKGROUND

1. Field

This application relates to the mounting of an electric fence insulator onto rail fencing, specifically for mounting onto vinyl and wood rail fencing.

2. Prior Art

As with most ranchers, farmers and/or livestock owners with many years of raising horses, cattle, sheep and other livestock, that although a post and rail fence (be it vinyl or wood) is more pleasant to look at compared to woven wire fencing, it is also more difficult to keep livestock from leaning on it, or trying to crawl through it, or reaching underneath it. The best and most humane deterrent to the above is to install an electrified fence system.

Although the concept of an electrified fence is not unique, the mechanisms (insulators) that are used to hold the electric wire and electric ribbon onto the various types of fencing can be. There are many other types of insulators designed to install onto standalone steel or wood posts for use with woven wire fencing, but for vinyl and wood rail fencing there are very few. Our product is designed and used strictly by consumers with vinyl and wood rail fencing.

Current vinyl or wood rail insulators require either nails, screws, or glue to be used to secure them to the poles or fencing, permanently damaging the plastic or wood that it is mounted on. To raise or lower the electrical fencing insulators requires additional gluing, drilling and/or nailing onto the new locations which creates additional damage and weakening of the existing fencing. The other option for the consumer is to purchase additional insulators to install onto the new locations (higher or lower) to meet the need of the livestock, requiring additional screws, glue or nails to install. This leaves the original insulators unattractively attached to the posts and unused.

SUMMARY

Current vinyl and wood rail insulators do not provide a flexible nor attractive solution for the consumer that does not damage and/or weaken the original posts that they are installed on.

BRIEF DESCRIPTION OF THE DRAWINGS

In the drawings, closely related figures have the same number but different alphabetic suffixes.

FIG. 2A shows the side view dimensions of the insulator installed onto a standard 2×6 rail fence.

FIG. 2B shows the top view dimensions of the insulator installed onto a standard 2×6 rail fence.

FIG. 2C shows the front view of the insulator installed onto a standard 2×6 rail fence.

Drawings—Reference Numerals

1—Easy Snap Insulator
2—Body of Insulator
3—Living Hinge
4—Body Leg
5—Rail Leg
6—Bottom Clip
7—Hinge Clip

DETAILED DESCRIPTION—FIGS. 1A THRU 1D—FIRST EMBODIMENT

Figure 1A:
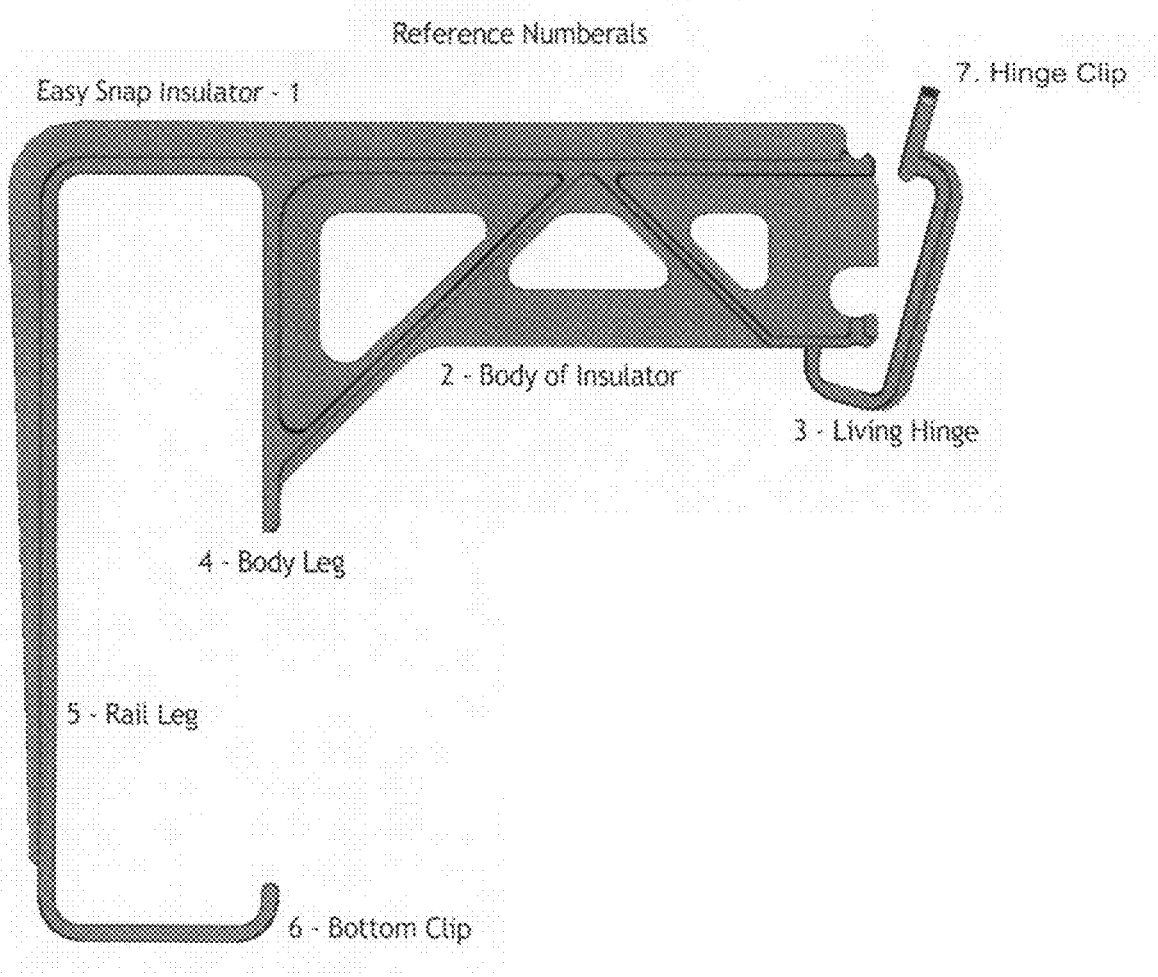
FIG. 1A shows the description and reference numbers of the invention when referencing or discussing the various areas of the product.
Figure 1B:
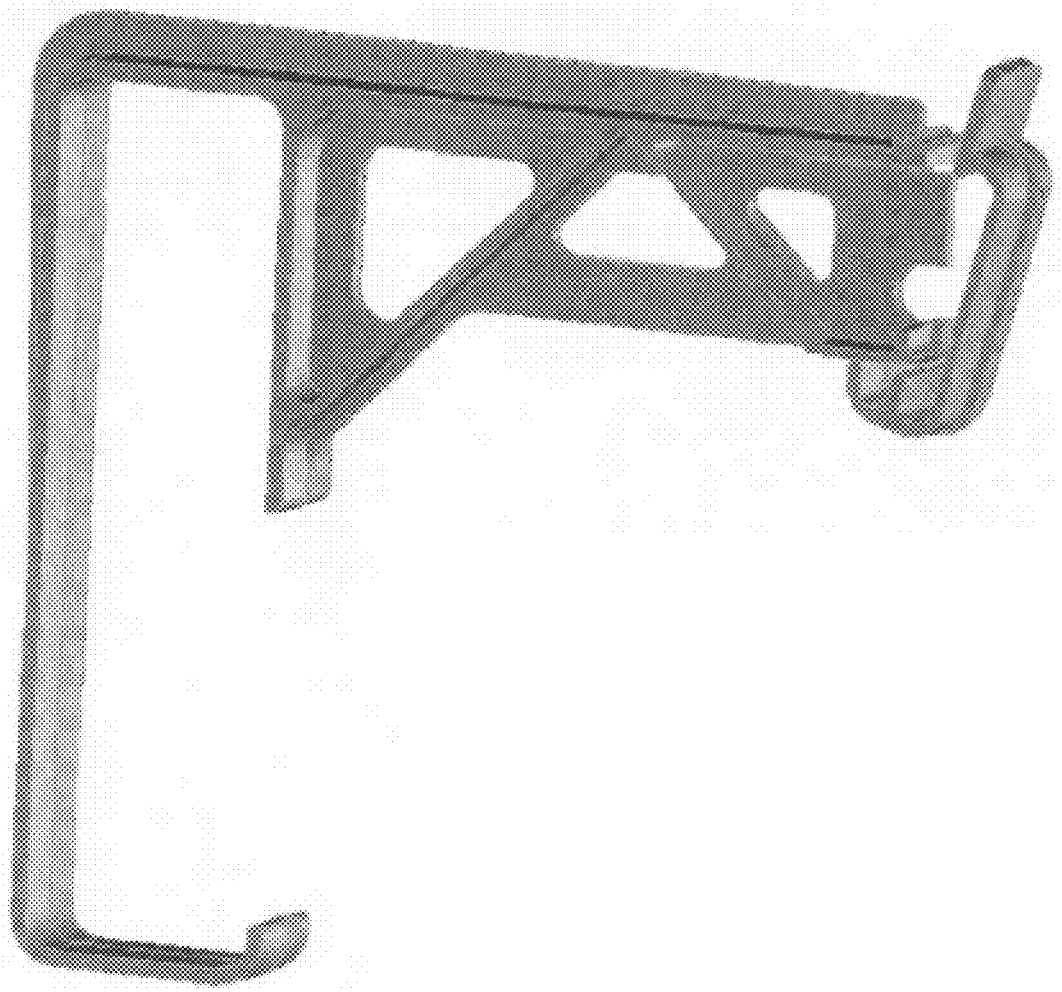
FIG. 1B shows a 3-dimensional side view of the invention.
Figure 1C:
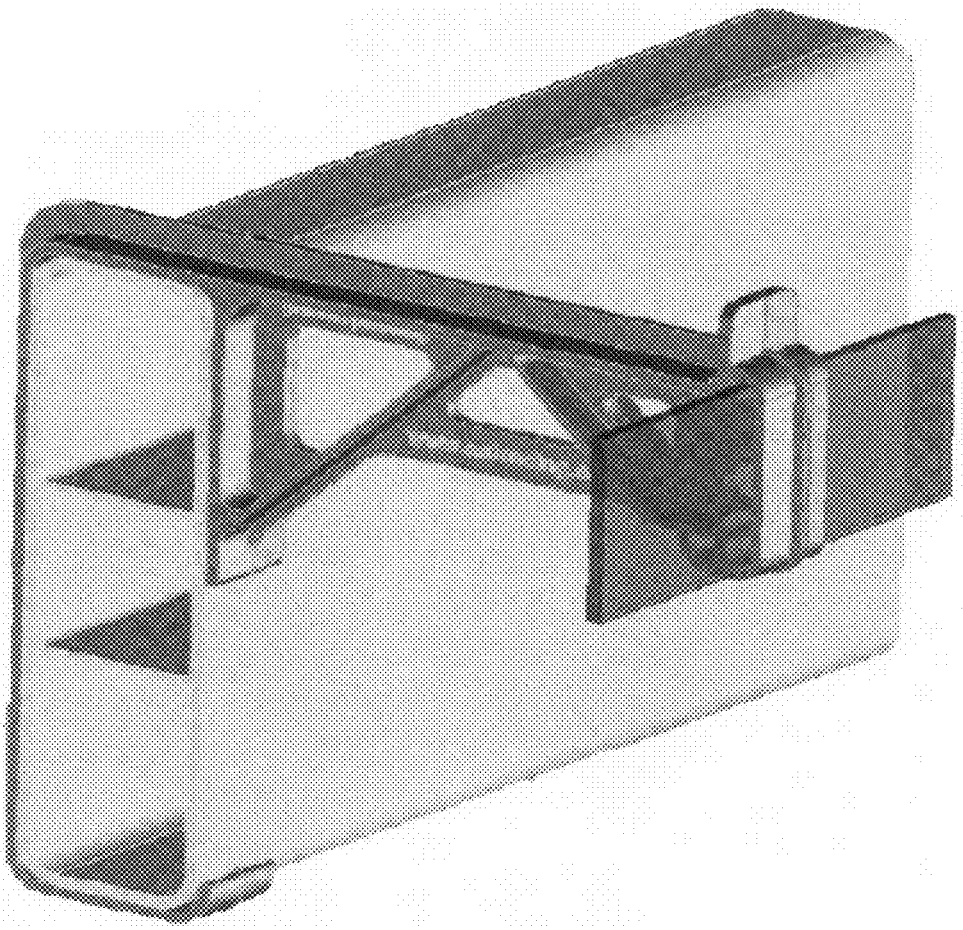
FIG. 1C shows a 3-dimensional side view of the invention with electric tape inserted into the living hinge.
Figure 1D:
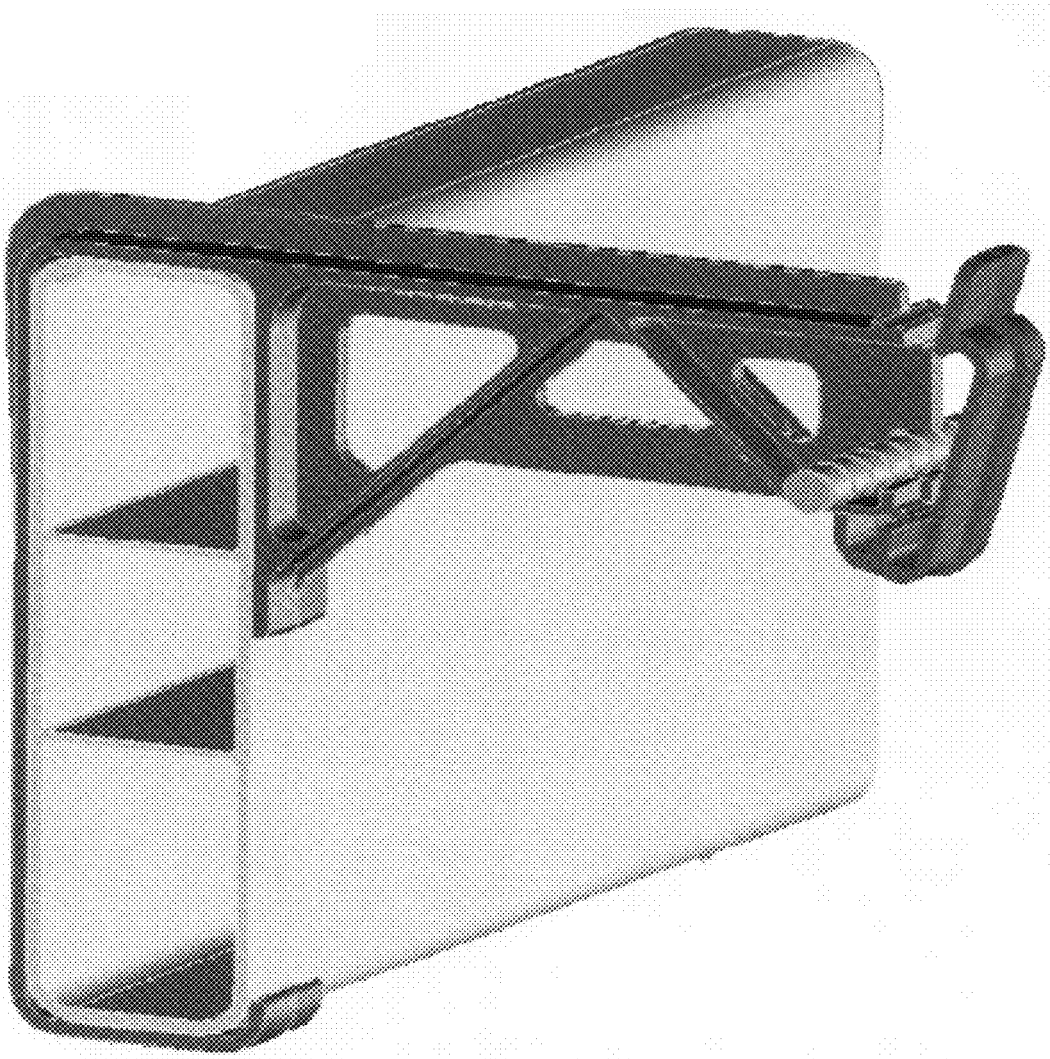
FIG. 1D shows a 3-dimensional side view of the invention with electric tape inserted into the living hinge.

One embodiment of a poly-propylene electric fence insulator is illustrated in FIG. 1A (side view), FIG. 1B (side angle), FIG. 1C (electric tape) and FIG. 1D (electric rope). It is a one piece unit that fits snugly and securely over a wood or vinyl fence rail with no other fastening devices necessary (number. 1). It is designed and engineered to utilize and combine the strength and support of the rail fencing as part of the insulator strength.

The Body of the Insulator (FIG. 1A, number 2) was designed and engineered with support angles and ribbing to reinforce the extended arm that holds the insulator, allowing it to withstand the downward and side-to-side weight and pressure of the electric wire, tape or rope (FIG. 1B) when installed. It is also designed to remain flexible and non-brittle to avoid shattering in cold weather and/or from impact from livestock.

It has one moving part which is referred to in number 3 as a Living Hinge. It is made to be flexible so it may repeatedly open and close with out fracturing. The living hinge will receive and hold a variety of electrical conductors, including wire, rope or ribbon (FIG. 1C and FIG. 1D). Once the wire, tape or rope is inserted, the clip is pressed inward until it snaps securely into the hinged catch slot on the top of the insulator. To reopen the Living Hinge, simply pull the top tab away from the fencing until it releases from the catch slot.

When the Insulator is attached to the vinyl or wood rail fencing, the Body Leg referred to in number 4 rests directly against the vinyl or wood rail to support the downward pressure from the Body of Insulator when the electric wire, rope or tape has been attached.

The Rail Leg referred in number 5 rests against the long side of the rail fencing opposite the Body of Insulator. This provides enough outward flexibility to allow the Insulator to open enough to slide over the vinyl or wood rail between the Rail Leg and Body of Insulator.

As the Insulator is placed over and slid downward onto the vinyl or wood rail, the Bottom Clip referred in number 6 slides easily over the bottom of the rail. The raised clip edge on the end locks the insulator into place, keeping it from being lifted off of the rail without first sliding the clip down to release it. The hinge clip referred to as number 7 is the upper section of number 3 which is referred to as living hinge. The purpose of number 7 is to provide for a self locking system for the living hinge.

OPERATION—FIGS. 2A, 2B AND 2C

The various dimensions of the insulator, as well as the manner in which the insulator would appear on the vinyl or wood rail fence, is demonstrated in FIG. 2A (side view), FIG. 2B (top view) and FIG. 2C (front view). The FIG. 2A side view shows how the insulator fits securely and tightly onto the standard vinyl or wood rail with the Body Leg, Rail Leg and Bottom Clip using the structure and strength of the rail as it support foundation.

FIG. 2B (top view) shows how the insulator extends beyond the posts and rail to provide the protection the fencing needs from the livestock as well as the side-to-side strength that it provides. The insulator can also be attached and positioned next to a post for added strength and side-to-side support.

FIG. 2C (front view) shows how the insulator has a small visual footprint while keeping the electric fencing at the top of the fence rails and in front of the posts.

FIGS. 3A, 3B, 3C AND 3D—ALTERNATIVE EMBODIMENTS

Figure 3A:
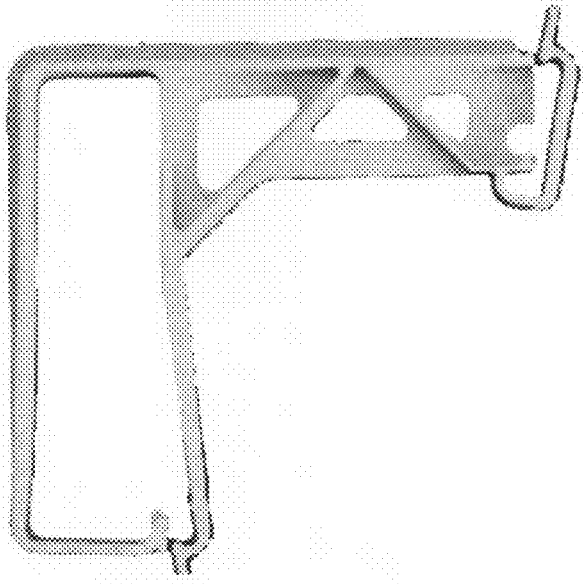
FIG. 3A shows an optional design for the insulator with a rail latch at bottom of insulator.

FIG. 3A shows the addition of a bottom latch. Although designed to work effectively without a bottom latch, future production may include a secondary latch for more secure installs should the consumer request them.

Figure 3B:
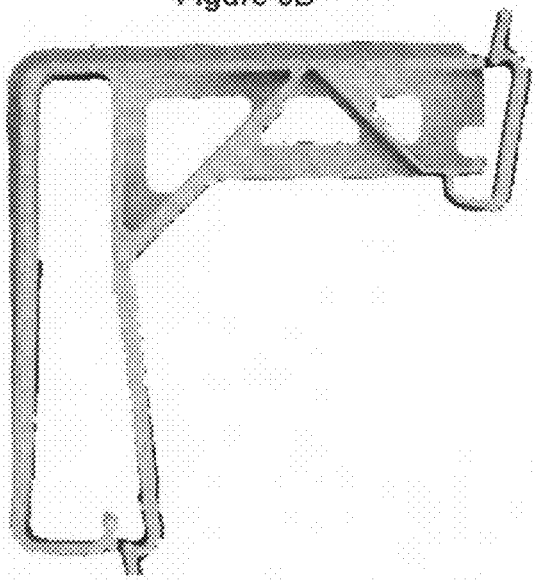
FIG. 3B shows an optional design for the insulator for 1×6 rail fences with a rail latch at bottom of insulator.

FIG. 3B shows how the insulator can be produced to meet the various needs of other sized rail fencing consumers 1×6. This can be modified to work with 1×4, 2×4 and 2×8 rail fencing.

Figure 3C:
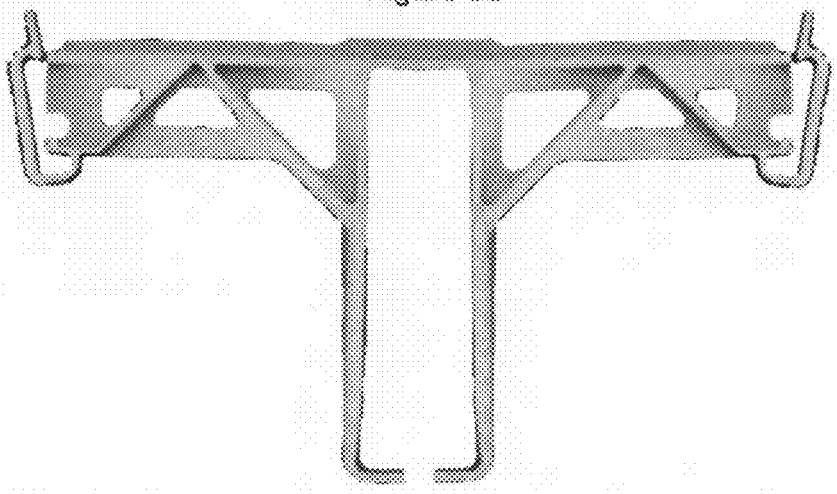
FIG. 3C shows an optional T-Bar Dual Insulator design for the insulator that allows for attaching electric fencing on both sides of the insulator with no latch at bottom of insulator.

FIG. 3C shows the T-Bar Dual Insulator that can be placed over the fence rail to support a center fence line that has electric fencing on both sides.

Figure 3D:
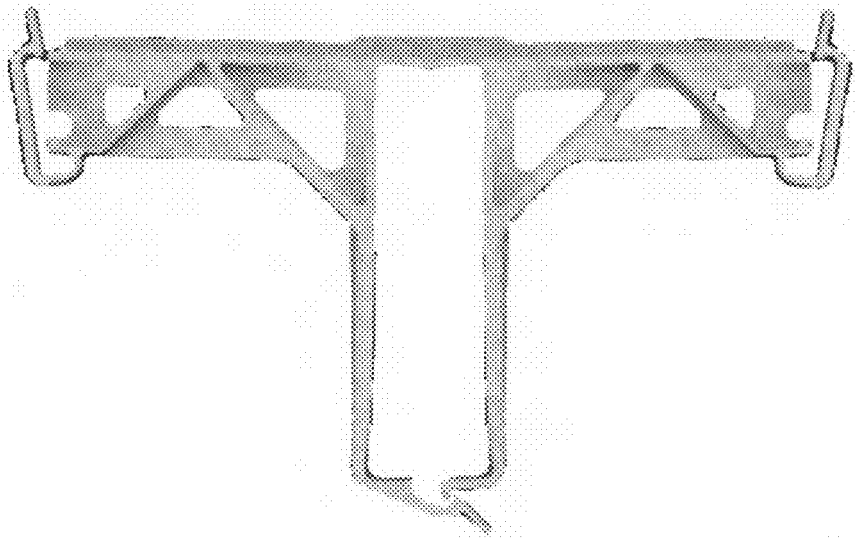
FIG. 3D shows an optional T-Bar Dual Insulator design for the insulator that allows for attaching electric fencing on both sides of the insulator with a rail latch at bottom of insulator.

FIG. 3D shows the T-Bar Dual Insulator that can be placed over the fence rail to support a center fence line that has electric fencing on both sides with a rail latch at the bottom. This also can be designed to support various rail dimensions (1×6, 1×4, 2×8).

ADVANTAGES

Our EasySnap Insulators require no nails, screws or glue to attach them to the wood or plastic fencing. It is designed to simply and securely snap over vinyl or wood fence railing and can be easily (but securely) adjusted up or down the horizontal fence rails or laterally on the individual rail that it is attached. This allows the electrical fencing to best meet the various locations and/or height requirements of the live stock (horses, cattle, sheep) within the fencing, or to best meet the prevention/training requirements of having the electrical fencing installed for (prevent them from reaching over, through or under the fencing).

The threading mechanism that is used to attach or run the electrical wire or tape through the insulator is also extremely important and needs to be simple and easy to use, yet securely hold the electrical wire or tape in place. Our wire/tape threading mechanism allows the user to easily secure the wire/tape to the insulator, locking it securely in place, yet also providing a simple but secure release mechanism to free the wire/tape as needed.

We have also found as have many other people that it is more efficient if the "Hot" wire projects out from the front of the fence rails a few inches as it is more visible to the animals and less likely to come into contact with a grounding device that would defeat the flow of electrical current through the fencing. Our EasySnap Insulator securely holds the wire/tape away from the fencing without compromising the strength and purpose of the insulator.

Our product is made from a plastic resin material and produced using a cavity injection mold process. It can be made in a variety of colors and sizes to match various vinyl fencing colors (primarily white) as well as the color needs of various wood fencing (natural or painted).

We feel our product is unique and has a strong need for people with livestock who use vinyl or wood rail fencing.

CONCLUSION, RAMIFICATIONS AND SCOPE

Our insulator is unique in its design, as its purpose is to fit over a 1½×5½ inch vinyl or wood rail fence. It requires no mechanical fasteners such as screws or nails. The unique feature is the way it holds onto the rail by means of friction and the return clip on the bottom end. It is injection molded in one piece, with a living hinge at the top to hold the electric fence wire, rope, or ribbon up to 1½ inches wide. It is made of poly prophelene with a U.V. Ultra Violet blocker. Each unit weighs about one ounce and are very durable and safe as they will bend rather than break. As with most vinyl based material they have a memory and will return to there manufactured shape if you bend them. We can produce them in a variety of colors to meet the customer's needs.

In all of our research, we have not found another insulator that has any resemblance to the one we make. It has been very well received in the livestock industry.

Although the description above contains many specificities, these should not be construed as limiting the scope of the embodiments but as merely providing illustrations of some of the presently preferred embodiments. For example, the type or size of rail fencing that the insulator can fit over, or the type of rail latch mechanism that can be used, or the color of the insulator is produced in.

Thus the scope of the embodiments should be determined by the appended claims and their legal equivalents, rather than by the examples given.

I claim:

1. A poly-propylene electric fence easy snap insulator comprising:

a one piece unit that fits snugly and securely over a wood or vinyl fence rail with no other fastening devices, said insulator further comprises a living hinge, a body of insulator, a body leg, a bottom clip, a rail leg and a hinge clip, said living hinge is made to be flexible so it may repeatedly open and close without fracturing, the living hinge will receive and hold a variety of electrical conductors, wires, rope or ribbon, once the conductors, the wires, the rope and the ribbon being inserted, said clip is pressed inward until it snaps securely into the hinge catch a slot on a top of the insulator, the rail leg rests against a long side of the rail fencing opposite the body of insulator this provides enough outward flexibility to allow the insulator to open enough to slide over the vinyl or said wood rail between the rail leg and the body of insulator, as the insulator is placed over and slid downward onto the vinyl or the wood rail, the bottom clip slides easily over a bottom of the rail and keeping it from being lifted off from the rail without fist sliding the clip down to release it.

* * * * *